US009019178B2

(12) United States Patent
Tan et al.

(10) Patent No.: US 9,019,178 B2
(45) Date of Patent: Apr. 28, 2015

(54) PIXEL UNIT DRIVING CIRCUIT, PIXEL UNIT AND DISPLAY DEVICE

(71) Applicants: BOE Technology Group Co., Ltd., Beijing (CN); Chengdu BOE Optoelectronics Technology Co., Ltd., Chengdu, Sichuan (CN)

(72) Inventors: Wen Tan, Beijing (CN); Xiaojing Qi, Beijing (CN)

(73) Assignees: BOE Technology Group Co., Ltd., Beijing (CN); Chengdu BOE Optoelectronics Technology Co., Ltd., Chengdu, Sichuan (CN)

( * ) Notice: Subject to any disclaimer, the term of this patent is extended or adjusted under 35 U.S.C. 154(b) by 40 days.

(21) Appl. No.: 13/996,138

(22) PCT Filed: Dec. 27, 2012

(86) PCT No.: PCT/CN2012/087715

§ 371 (c)(1),
(2) Date: Jun. 20, 2013

(87) PCT Pub. No.: WO2013/102416

PCT Pub. Date: Jul. 11, 2013

(65) Prior Publication Data

US 2014/0152190 A1 Jun. 5, 2014

(30) Foreign Application Priority Data

Jan. 4, 2012 (CN) ..... 2012 2 0001573 U

(51) Int. Cl.

| | |
|---|---|
| ***G09G 3/30*** | (2006.01) |
| ***H05B 33/08*** | (2006.01) |
| ***G09G 3/32*** | (2006.01) |

(52) U.S. Cl.

CPC .... *H05B 33/0896* (2013.01); *G09G 2300/0819* (2013.01); *G09G 2300/0876* (2013.01); *G09G 3/3241* (2013.01)

(58) Field of Classification Search

CPC ..... G09G 3/30; H05B 33/0896

USPC ..... 315/228, 240, 169.4; 345/76, 204, 82

See application file for complete search history.

(56) References Cited

U.S. PATENT DOCUMENTS 7,859,491 B2 * 12/2010 Lee et al. ..... 345/76
2001/0019327 A1 * 9/2001 Kim et al. ..... 345/204

(Continued)

FOREIGN PATENT DOCUMENTS

CN 1534579 A 10/2004
CN 202422687 U 9/2012

OTHER PUBLICATIONS

International Search Report dated Mar. 28, 2013; PCT/CN2012/087715.

(Continued)

*Primary Examiner* — Douglas W Owens
*Assistant Examiner* — Wei Chan
(74) *Attorney, Agent, or Firm* — Ladas & Parry LLP

(57) ABSTRACT

A pixel unit driving circuit, a pixel unit and a display device, wherein said pixel unit driving circuit of the pixel unit comprises a switching unit (201) having a first terminal connected to a high-voltage signal terminal (Vdd), a second terminal connected to a light-emitting device (OLED), a third terminal connected to a first control line (CN1), and a fourth terminal connected to a second control line (CN2); a driving transistor (T1) having a drain connected to the switching unit (201), and a source connected to a low-voltage signal terminal (Vss); and a capacitance storage unit (202) having a first terminal connected to the gate of the driving transistor (T1), a second terminal connected to the source of the driving transistor (T1), and a third terminal connected to the second control line (CN2). Amount and on-off of the driving current $I_{oled}$ and data current $I_{data}$ can be controlled via the switching unit (201) to make the current scaling ratio $I_{data}/I_{oled}$ change inversely as $I_{oled}$ changes, thus guaranteeing the data current $I_{data}$ can quickly charge the first capacitor regardless of amount of the driving current $I_{oled}$.

9 Claims, 5 Drawing Sheets

(56) References Cited

U.S. PATENT DOCUMENTS

| | | | | |
|---|---|---|---|---|
| 2004/0056828 | A1* | 3/2004 | Choi et al. | 345/82 |
| 2004/0196223 | A1 | 10/2004 | Kwon | |
| 2007/0268220 | A1* | 11/2007 | Lee et al. | 345/76 |
| 2008/0106208 | A1* | 5/2008 | Choi et al. | 315/169.3 |
| 2009/0231241 | A1* | 9/2009 | Abe | 345/76 |
| 2009/0303163 | A1* | 12/2009 | Kohno et al. | 345/76 |

OTHER PUBLICATIONS

International Preliminary Report on Patentability dated Jul. 8, 2014; PCT/CN2012/087715.

* cited by examiner

PIXEL UNIT DRIVING CIRCUIT, PIXEL UNIT AND DISPLAY DEVICE

FIELD OF THE INVENTION

The present invention relates to the technical field of the organic electroluminescent device, and specifically relates to a pixel unit driving circuit, a pixel unit and a display device.

BACKGROUND

The display manner of an electroluminescence display device such as an organic light-emitting diode (OLED) display is different from that of a conventional liquid crystal display. Since backlight is not needed in an OLED display, the OLED display device can be made lighter, thinner and with a greater viewing angle, and can significantly save energy, thus the OLED display technology becomes more and more popular.

An OLED display includes a driving circuit and an OLED light-emitting device. Electric current is outputted through the driving circuit to drive the light-emitting device to emit light with different luminance. FIG. 1 shows the pixel structure of an OLED display in the prior art. As shown in FIG. 1, an OLED pixel in the prior art includes a first signal line CN1, a second signal line CN2, a driving circuit and an OLED light-emitting device, wherein the driving circuit comprises a capacitor Cst, a driving transistor T1, a second transistor T2, a third transistor T3 and a fourth transistor T4. The capacitor Cst is connected in series between the gate and source of the driving transistor T1, the third transistor T3 and the fourth transistor T4 is connected in series between the gate and drain of the driving transistor T1, the drain of the driving transistor T1 is connected to the source of the second transistor 12, the first signal line CN1 is respectively connected to the gate of the third transistor T3 and the gate of the fourth transistor T4, and the second signal line CN2 is connected to the gate of the second transistor T2. The driving circuit receives an external input data current $I_{data}$ which will be stored in the capacitor Cst, and then the capacitor Cst generates driving current $I_{oled}$ driving OLED to emit light, the data current $I_{data}$ in the prior art being equal to the driving current $I_{oled}$. Since the driving current $I_{oled}$ required when OLED emits light is relatively lower, the data current $I_{data}$ is also relatively lower. When the capacitor Cst is relatively large, it takes a longer time for a relatively low data current $I_{data}$ to charge the capacitor Cst, and in the case of a low data current $I_{data}$, the charging time of the capacitor Cst will be very long, resulting in a slow refresh rate of the OLED display.

SUMMARY

In order to solve the above-mentioned problems, the present disclosure provides a pixel unit driving circuit, a pixel unit and a display device for solving the problems of slow refresh rate of the pixel unit in the prior art.

To this end, an embodiment of the present disclosure is to provide a pixel unit driving circuit, comprising:

a switching unit having a first terminal connected to a high-voltage signal terminal, a second terminal connected to a light-emitting device, a third terminal connected to a first control line, and a fourth terminal connected to a second control line;

a driving transistor having a drain connected to the switching unit, and a source connected to a low-voltage signal terminal;

a capacitance storage unit having a first terminal connected to the gate of the driving transistor, a second terminal connected to the source of the driving transistor, and a third terminal connected to the second control line.

Wherein said capacitance storage unit includes: a first capacitor, a second capacitor, and a fifth transistor; wherein said first capacitor having one terminal connected to the gate of said driving transistor, and another terminal connected to the source of the driving transistor;

said second capacitor having one terminal connected to the gate of said driving transistor, and another terminal connected to the drain of said fifth transistor;

said fifth transistor having a gate connected to said second control line, and a source connected to the source of said driving transistor.

Wherein said capacitance storage unit includes: a first capacitor, a second capacitor, and a fifth transistor; wherein said first capacitor having one terminal connected to the gate of the driving transistor, and another terminal connected to one terminal of said second capacitor;

said second capacitor having another terminal connected to the source of the driving transistor;

said fifth transistor having a drain connected between said first capacitor and second capacitor, a gate connected to the second control line, and a source connected to the source of said driving transistor.

Wherein said switching unit comprises: a second transistor, and a fourth transistor;

said second transistor having a drain connected to the high-voltage signal terminal, a gate connected to the second control line, and a source connected to the drain of said driving transistor;

said fourth transistor having a source connected to the gate of said driving transistor, a gate connected to the first control line, and a drain connected to the high-voltage signal terminal.

Wherein said switching unit further comprises:

a third transistor having a source connected to the drain of said driving transistor, a drain connected to the high-voltage signal terminal, and a gate connected to the first control line.

Wherein said driving transistor, the second transistor, the third transistor, the fourth transistor, and the fifth transistor are n-type thin film transistors.

An embodiment of the present disclosure provides a pixel unit, including an OLED, and any one of the aforementioned pixel unit driving circuit, said pixel unit driving circuit being connected to the cathode of said OLED, the anode of said OLED being connected to the high-voltage signal terminal.

An embodiment of the present disclosure provides a display device, comprising the aforementioned pixel unit.

An embodiment of the present disclosure has the following beneficial effects:

The pixel unit driving circuit as provided by an embodiment of the present disclosure via the switching unit controls amount and on-off of the driving current $I_{oled}$ and data current $I_{data}$ to make the current scaling ratio $I_{data}/I_{oled}$ change inversely as $I_{oled}$ changes, thus guaranteeing the data current $I_{data}$ can quickly charge the capacitance storage unit regardless of amount of the driving current $I_{oled}$.

The pixel unit and display device as provided by an embodiment of the present disclosure via the switching unit control amount and on-off of the driving current $I_{oled}$ and data current $I_{data}$ to make the current scaling ratio $I_{data}/I_{oled}$ change inversely as $I_{oled}$ changes, thus guaranteeing the data current $I_{data}$ can quickly charge the first capacitor regardless of amount of the driving current $I_{oled}$, so as to improve the refresh rate of the pixel unit, which is helpful for achieving a high-resolution display of an image and meanwhile reducing the power consumption of the power supply when a high-brightness image is displayed. In addition, the driving current $I_{oled}$ can be controlled by controlling numeric value of the external input data current $I_{data}$, thus controlling the display luminance of the light-emitting device.

Due to the symmetry characteristic of the source and drain structure of the transistor, the source and drain are not strictly distinguished from each other in some cases of the present disclosure, and the source and drain are interchangeable.

DETAILED DESCRIPTION

In the following, the pixel unit driving circuit, the pixel unit and the display device provided by the present disclosure are to be described in detail in conjunction with the accompanying drawings, so as to provide a better understanding of the technical solution of the disclosure for the skilled in the art.

Figure 1:
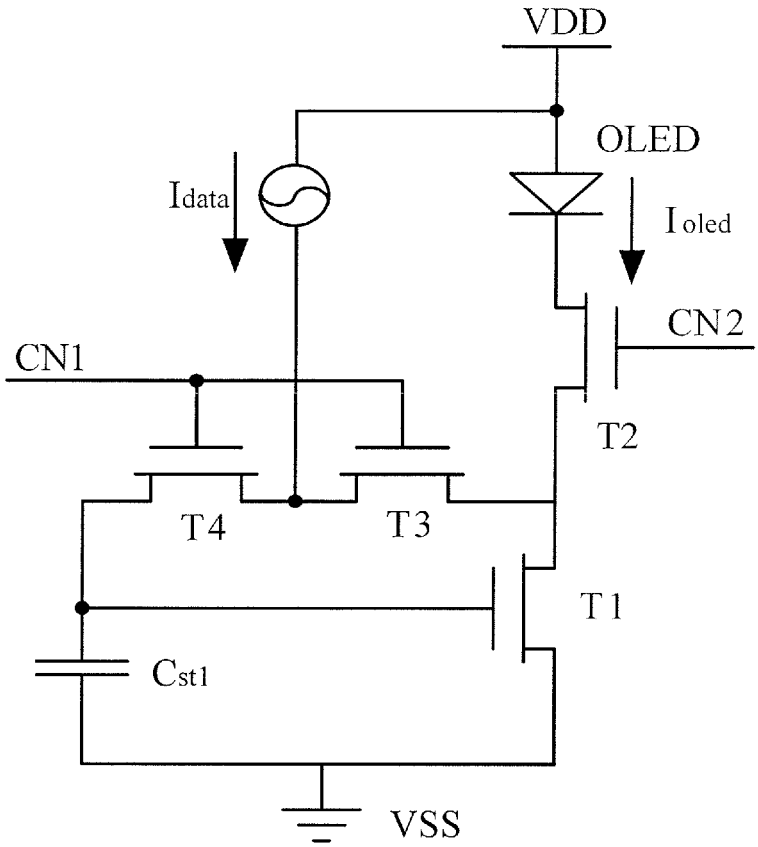
FIG. 1 illustrates the structure of a pixel in an OLED display in the prior art.
Figure 2:
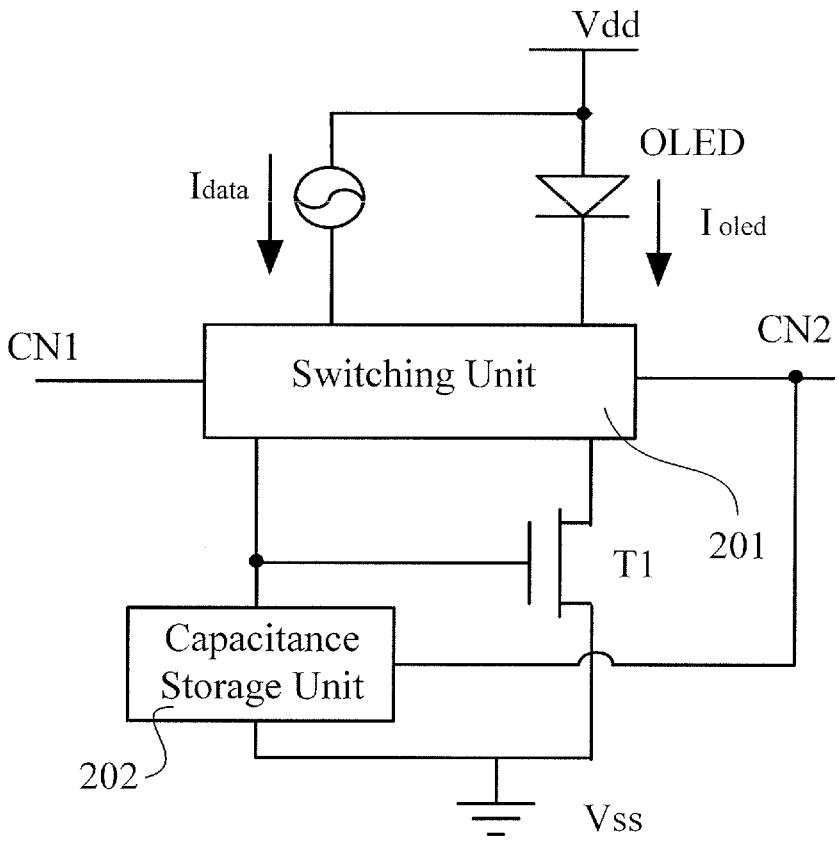
FIG. 2 is a schematic diagram of structure of a pixel unit driving circuit according to a first embodiment of the disclosure.

FIG. 2 is a schematic diagram of structure of a pixel unit driving circuit according to a first embodiment of the disclosure. As shown in FIG. 2, in this embodiment a pixel unit driving circuit includes a switching unit 201, a capacitance storage unit 202, and a driving transistor T1. Wherein a first terminal of the switching unit 201 is connected to a high-voltage signal terminal, a second terminal of the switching unit 201 is connected to a light-emitting device, a third terminal of the switching unit 201 is connected to a first control line CN1, and a fourth terminal of the switching unit 201 is connected to a second control line CN2; a first terminal of the capacitance storage unit 202 is connected to the gate of the driving transistor T1, a second terminal of the capacitance storage unit 202 is connected to the source of the driving transistor T1, and a third terminal of the capacitance storage unit 202 is connected to the second control line CN2; a drain of the driving transistor T1 is connected to the switching unit 201, and a source of the driving transistor T1 is connected to a low-voltage signal terminal Vss;

The first control line CN1 outputs a high-level control signal to the switching unit 201, the switching unit 201 is turned on, a low-level signal is respectively outputted to the switching unit 201 and the capacitance storage unit 202 via the second control line CN2, the high potential of the power supply Vdd outputs the data current $I_{data}$, the data current $I_{data}$ will be stored in the capacitance storage unit 202, and the quantity of electricity stored in the capacitance storage unit 202 is Q; current between the drain and source of the driving transistor T1 is $I_{ds1}$, $I_{data}=I_{ds1}$, and at this time voltage between the gate and source of the driving transistor T1 is Vgs; the quantity of electricity stored in the capacitance storage unit 202 is Q; a low-level control signal is outputted to the switching unit 201 via the first control line CN1, a high-level signal is respectively outputted to the switching unit 201 and the capacitance storage unit 202 via the second control line CN2, voltage of the capacitance storage unit 202 will be reduced, the power supply outputs a driving current $I_{oled}$ to the OLED, at this time voltage of the capacitance storage unit 202 is equal to voltage $V'_{gs}$ between the gate and source of the driving transistor T1, and the driving current $I_{oled}$ outputted by the power supply to the OLED is equal to the current $I'_{ds1}$ flowing through the drain and source of the driving transistor. Therefore, the data current $I_{data}$ is smaller than the driving current $I_{oled}$, and variation amplitude of the data current $I_{data}$ is also smaller than that of the driving current $I_{oled}$. At the same time when the current scaling ratio $I_{data}/I_{oled}$ changes inversely as $I_{oled}$ changes, the data current $I_{data}$ would not be too small, thus guaranteeing the data current $I_{data}$ can quickly charge the capacitance storage unit regardless of amount of the driving current $I_{oled}$.

Figure 3:
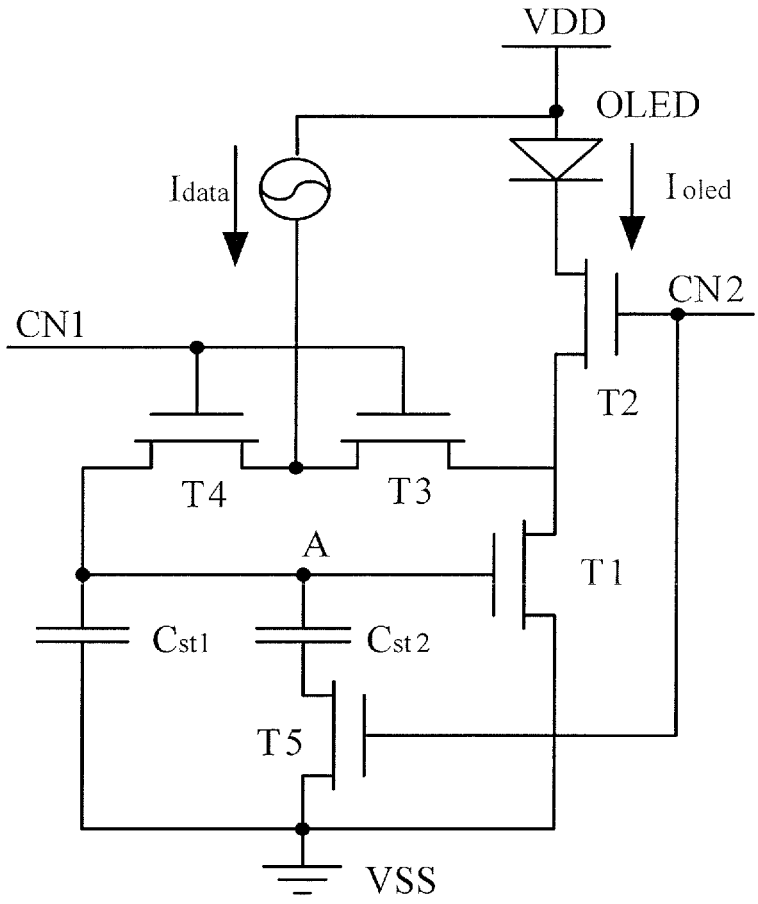
FIG. 3 is a schematic diagram of structure of a pixel unit driving circuit according to a second embodiment of the disclosure.

FIG. 3 is a schematic diagram of structure of a pixel unit driving circuit according to a second embodiment of the disclosure. As shown in FIG. 3, the capacitance storage unit in the pixel unit driving circuit according to the present embodiment includes a first capacitor Cst1, a second capacitor Cst2, and a fifth transistor T5; wherein one terminal of the first capacitor Cst1 is connected to the gate of the driving transistor T1 and another terminal of the first capacitor Cst1 is connected to the source of the driving transistor T1, one terminal of the second capacitor Cst2 is connected to the gate of the driving transistor T1 and another terminal of the second capacitor Cst2 is connected to the drain of the fifth transistor T5, and a gate of the fifth transistor T5 is connected to the second control line CN2 and a source of the fifth transistor T5 is connected to the source of the driving transistor T1; the switching unit includes a second transistor T2 and a fourth transistor T4, a drain of the second transistor T2 is connected to a high-voltage signal terminal Vdd via an OLED, a gate of the second transistor T2 is connected to the second control line CN2 and a source of the second transistor T2 is connected to the drain of the driving transistor T1, and a drain of the fourth transistor T4 is connected to the gate of the driving transistor T1, a gate of the fourth transistor T4 is connected to the first control line CN1 and a drain of the fourth transistor T4 is connected to the high-voltage signal terminal Vdd.

Further, the switching unit in pixel unit driving circuit according to the present embodiment further comprises a third transistor T3, a source of the third transistor T3 is connected to the drain of the driving transistor T1, a drain of the third transistor T3 is connected to the high-voltage signal terminal Vdd, and a gate of the third transistor T3 is connected to the first control line CN1. When an open circuit fault occurs in the fourth transistor 14, the first control line CN1 can still control the switching unit 201 through the third transistor T3 to enhance the stability of the switching unit.

Figure 4:
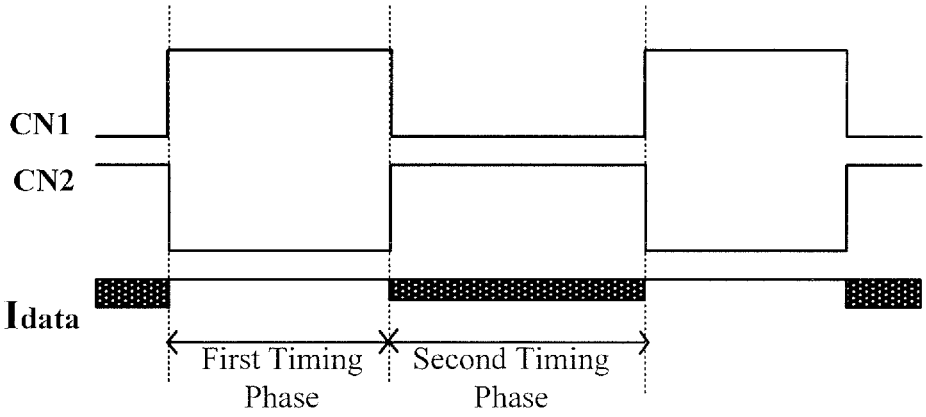
FIG. 4 is a timing signal diagram of the pixel unit driving circuit shown in FIG. 3.
Figure 5:
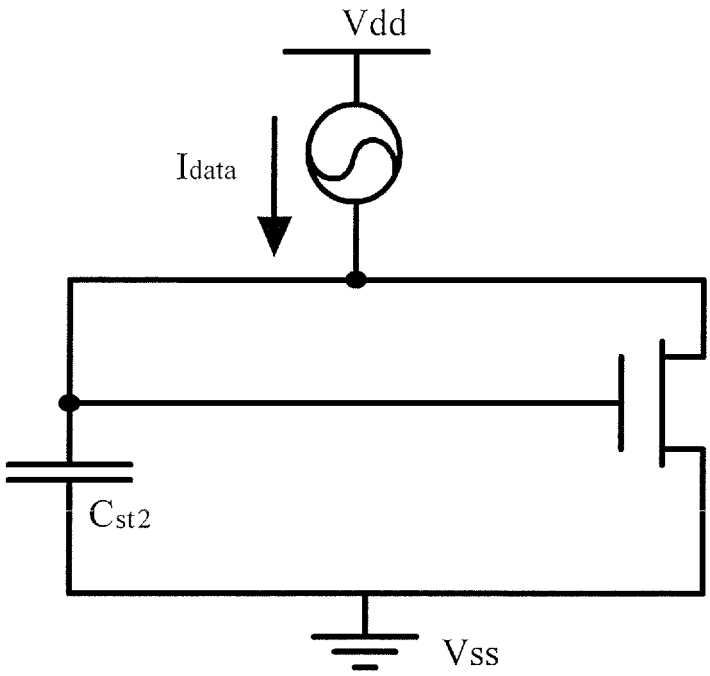
FIG. 5 is a diagram illustrating an equivalent circuit of the pixel unit driving circuit shown in FIG. 3 during a first timing phase.
Figure 6:
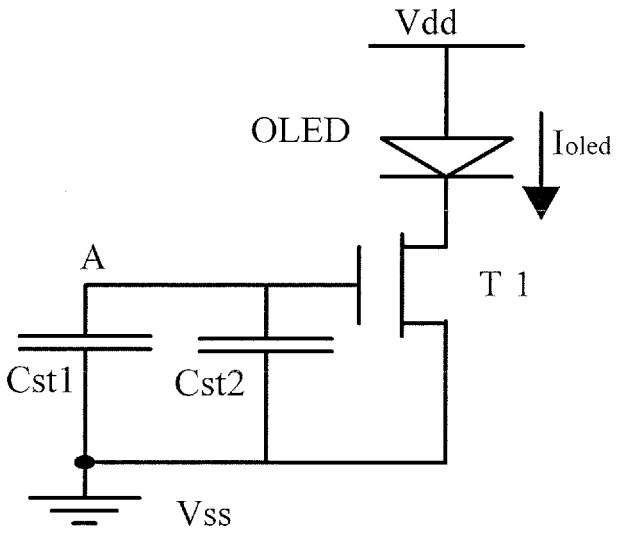
FIG. 6 is a diagram illustrating an equivalent circuit of the pixel unit driving circuit shown in FIG. 3 during a second timing phase.

FIG. 4 is a timing signal diagram of the pixel unit driving circuit shown in FIG. 3, FIG. 5 is a diagram illustrating an equivalent circuit of the pixel unit driving circuit shown in FIG. 3 during a first timing phase, and FIG. 6 is a diagram illustrating an equivalent circuit of the pixel unit driving circuit shown in FIG. 3 during a second timing phase. As shown in FIG. 4, in the first timing phase, a high-level control signal is respectively outputted to the gate of the third transistor T3 and the gate of the fourth transistor T4 via the first control line CN1, and the third transistor T3 and the fourth transistor T4 are turned on; a low-level control signal is respectively outputted to the gate of the second transistor T2 and the gate of the fifth transistor T5 via the second control line CN2, and the second transistor and the fifth transistor are turned off. During the first timing phase, an equivalent circuit of the driving circuit is as shown in FIG. 5, the high potential of the power supply Vdd outputs data current $I_{data}$, the data current $I_{data}$ will be stored in the first capacitor Cst1, at the same time the driving transistor T1 is in a saturated state, the current between the drain and source of the driving transistor T1 is $I_{ds1}$, $I_{data}=I_{ds1}$, and at this time voltage between the gate and source of the driving transistor T1 is Vgs=Va−Vss, wherein Va is the level at A, and Vss is the low level of the power supply.

At the terminal of the first timing phase, the quantity of electricity stored in the first capacitor Cst1 is Q, and voltage of the first capacitor Cst1 is equal to voltage Vgs between the gate and source of the driving transistor T1, which can be obtained according to the formula:

$$V_{gs} = \frac{Q}{Cst1} \tag{1}$$

Wherein the current $I_{ds1}$ between the source and drain of the driving transistor T1 is as shown in formula (2):

$$I_{ds1} = \frac{1}{2}k1(V_{gs} - V_{th})^2 \tag{2}$$

Since $I_{data}=I_{ds1}$, formula (3) can be obtained according to the formula (2), and the formula (3) is as follows:

$$I_{data} = I_{ds1} = \frac{1}{2}k1(V_{gs} - V_{th})^2 \tag{3}$$

Formula (4) can be obtained according to formula (1), formula (2) and formula (3), and formula (4) is as follows:

$$I_{data} = \frac{1}{2}k1(V_{gs} - V_{th})^2 = \frac{1}{2}k1\left(\frac{Q}{C_{st1}} - V_{th}\right)^2 \tag{4}$$

Wherein K1 is the current parameter of the driving transistor.

As shown in FIG. 4 and FIG. 6, in the second timing phase, a low-level control signal is respectively outputted to the gate of the third transistor T3 and the gate of the fourth transistor T4 via the first control line CN1, and the third transistor T3 and the fourth transistor T4 are turned off; a high-level control signal is respectively outputted to the gate of the second transistor T2 and the gate of the fifth transistor T5 via the second control line CN2, and the second transistor and the fifth transistor are turned on. When the second transistor T2 is turned on, the power supply outputs current $I_{oled}$ to the OLED, and the driving current $I_{oled}$ outputted to the OLED by the power supply is equal to the current $I'_{ds1}$ flowing through the drain and source of the driving transistor T1; when the fifth transistor T5 is turned on, the first capacitor Cst1 and the second capacitor Cst2 are connected in parallel, and the parallel circuit is connected between the gate and source of the driving transistor T1. In this case, the quantity of electricity Q stored in the first capacitor Cst1 will be distributed between the first capacitor Cst1 and the second the capacitor Cst2 to make the voltages on the first capacitor Cst1 and the second capacitor Cst2 equal to each other, and the voltage on the first capacitor Cst1 and the second capacitor Cst2 is equal to the voltage $V'_{gs}$ between the gate and source of the driving transistor T1, wherein the voltage $V'_{gs}$ between the gate and source of the driving transistor T1 is as shown in formula (5):

$$V'_{gs} = \frac{Q}{Cst1 + Cst2} \tag{5}$$

Wherein the current $I'_{ds1}$ between the source and drain of the driving transistor T1 is as shown in formula (6):

$$I'_{ds1} = \frac{1}{2}K_1(V'_{gs} - V_{th})^2 \tag{6}$$

Due to $I_{oled}=I'_{ds1}$, formula (7) can be obtained according to the formula (6), and formula (7) is as follows:

$$I_{oled} = I'_{ds1} = \frac{1}{2}K_1(V'_{gs} - V_{th})^2 \tag{7}$$

Formula (8) can be obtained according to formula (5), formula (6) and formula (7), and formula (8) is as follows:

$$I_{oled} = \frac{1}{2}k1(V'_{gs} - V_{th})^2 = \frac{1}{2}k1\left(\frac{Q}{C_{st1} + C_{st2}} - V_{th}\right)^2 \tag{8}$$

The current scaling ratio $I_{data}/I_{oled}$ between the data current $I_{data}$ and the driving current $I_{oled}$ is calculated according to formula (4) and formula (8), and the current scaling ratio $I_{data}/I_{oled}$ is as shown in formula (9):

$$\frac{I_{data}}{I_{oled}} = \frac{\frac{1}{2}k\left(\frac{Q}{C_{st1}} - V_{th}\right)^2}{\frac{1}{2}k\left(\frac{Q}{C_{st1} + C_{st2}} - V_{th}\right)^2} = \left(\frac{\frac{Q}{Cst1} - V_{th}}{\frac{Q}{Cst1 + Cst2} - V_{th}}\right)^2 = \left(\frac{\frac{Q}{Cst1 + Cst2} + \frac{Cst2}{Cst1}\cdot\frac{Q}{Cst1 + Cst2} - V_{th}}{\frac{Q}{Cst1 + Cst2} - V_{th}}\right)^2 = \left(\frac{\frac{Cst2}{Cst1}\cdot\frac{Q}{Cst1 + Cst2}}{\frac{Q}{Cst1 + Cst2} - V_{th}} + 1\right)^2 = \left(\frac{\frac{Cst2}{Cst1}V'_{gs}}{V'_{gs} - V_{th}} + 1\right)^2 = \left(\frac{Cst2}{Cst1}\cdot\frac{\sqrt{\frac{2I_{oled}}{k1}} + V_{th}}{\sqrt{\frac{2I_{oled}}{k1}}} + 1\right)^2 = \tag{9}$$

-continued $$\left(\frac{Cst2}{Cst1}\cdot\frac{V_{th}\sqrt{k1}}{\sqrt{2I_{oled}}}+\frac{Cst1}{Cst2}+1\right)^2=$$

$$\frac{k1}{2}\left(\frac{Cst2V_{th}}{Cst1}\right)^2\left[\frac{1}{\sqrt{I_{oled}}}+\left(1+\frac{Cst1}{Cst2}\right)\frac{\sqrt{2}}{V_{th}\sqrt{k1}}\right]^2:=$$

$$a\left(\frac{1}{\sqrt{I_{oled}}}+b\right)^2$$

Wherein $$a=\frac{k1}{2}\left(\frac{Cst2\cdot V_{th}}{Cst1}\right)^2,\ b=\left(1+\frac{Cst1}{Cst2}\right)\frac{\sqrt{2}}{V_{th}\sqrt{k1}}.$$

According to formula (9), the current scaling ratio $I_{data}/I_{oled}$ changes inversely as $I_{oled}$ changes. When a large driving current $I_{oled}$ is needed, since the current scaling ratio is relatively small, the power consumption of the power supply when a high-brightness image is displayed is reduced, and meanwhile a large data current $I_{data}$ charges the first capacitor Cst1 quickly; when a small driving current $I_{oled}$ is needed, since the current scaling ratio is relatively large, a relatively large data current $I_{data}$ can still be maintained to charge the first capacitor Cst1, thus ensuring the data current $I_{data}$ charges the first capacitor Cst1 quickly to improve the refresh rate of the pixel unit, which is helpful for achieving a high-resolution display of an image.

Formula (10) can be obtained according to formula (9), and formula (10) is as follows:

$$\sqrt{I_{oled}}=\frac{1}{b\sqrt{a}}\cdot\sqrt{I_{data}}-\frac{1}{b} \tag{10}$$

As can be seen from formula (10), the driving current $I_{oled}$ is controlled by controlling numeric value of the external input data current $I_{data}$, and thus the display luminance of the light-emitting device can be precisely controlled.

Figure 7:
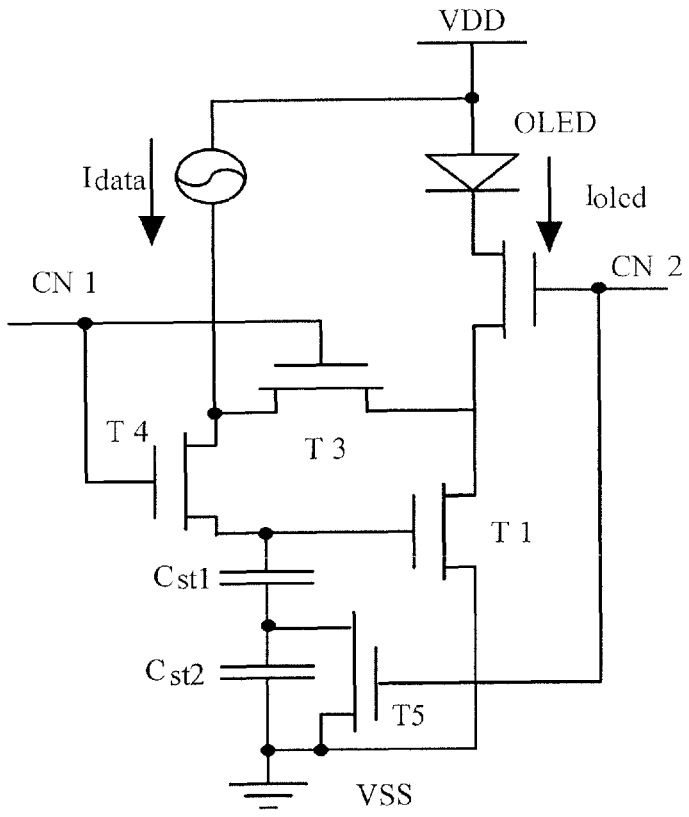
FIG. 7 is a schematic diagram of structure of a pixel unit driving circuit according to a third embodiment of the disclosure.

FIG. 7 is a schematic diagram of structure of a pixel unit driving circuit according to a third embodiment of the disclosure. As shown in FIG. 7, in the present embodiment, the storage unit includes a first capacitor Cst1, a second capacitor Cst2 and a fifth transistor T5, and the switching unit includes a second transistor T2 and a fourth transistor T4; wherein one terminal of the first capacitor Cst1 is connected to the gate of the driving transistor T1 and another terminal of the first capacitor Cst1 is connected to one terminal of the second capacitor Cst2, and another terminal of the second capacitor Cst2 is connected to the source of the driving transistor T1; a drain of the fifth transistor T5 is connected between the first capacitor Cst1 and the second capacitor Cst2, a gate of the fifth transistor T5 is connected to the second control line connection CN2, and a source of the fifth transistor T5 is connected to the source of the drive transistor T1; a drain of the second transistor 12 is connected with the high-voltage signal terminal Vdd via an OLED, a gate of the second transistor T2 is connected to the second control line CN2, and a source of the second transistor T2 is connected to the drain of the driving transistor T1; a source of the fourth transistor T4 is connected to the gate of the driving transistor T1, a gate of the fourth transistor T4 is connected to the first control line CN1, and a drain of the fourth transistor T4 is connected to the high-voltage signal terminal Vdd.

Further, in pixel unit driving circuit according to the present embodiment, the switching unit further comprises a third transistor T3, a source of the third transistor T3 is connected to the drain of the driving transistor T1, a drain of the third transistor T3 is connected to the high-voltage signal terminal Vdd, and a gate of the third transistor T3 is connected to the first control line CN1.

In practical applications, the sources and drains of the second transistor T2, the third transistor T3 and the fourth transistor T4 are functionally the same, so the aforementioned sources and drains can be interchangeably connected, and their functions in the driving circuit are the same. The driving transistor T1, the second transistor T2, the third transistor T3, the fourth transistor T4 and the fifth transistor T5 are n-type thin film transistors.

Figure 8:
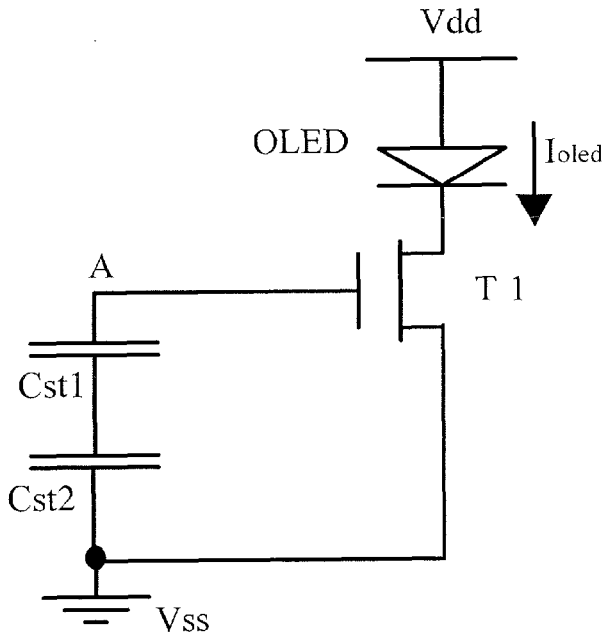
FIG. 8 is a diagram illustrating an equivalent circuit of the pixel unit driving circuit shown in FIG. 7 during a second timing phase.

FIG. 8 is a diagram illustrating an equivalent circuit of the pixel unit driving circuit shown in FIG. 7 during a second timing phase as shown in FIG. 4. In the present embodiment, when the timing signal shown in FIG. 4 is applied to the pixel unit driving circuit, the equivalent circuit of the pixel unit driving circuit during the first timing phase is as shown in FIG. 5. The equivalent circuit of the pixel unit driving circuit during the second timing phase is as shown in FIG. 8. As shown in FIG. 8, the first capacitor Cst1 and the second capacitor Cst2 are connected in series, the quantity of electricity Q stored in the first capacitor Cst1 will be distributed between the first capacitor Cst1 and the second the capacitor Cst2 to make the voltages on the first capacitor Cst1 and the second capacitor Cst2 equal to each other, and the voltage on the first capacitor Cst1 and the second capacitor Cst2 is equal to the voltage $V'_{gs}$ between the gate and source of the driving transistor T1, wherein the voltage $V'_{gs}$ between the gate and source of the driving transistor T1 is as shown in formula (5). Therefore, in the pixel unit driving circuit according to the second embodiment of the present disclosure, calculation of the electrical parameters such as data current $I_{data}$, driving current $I_{oled}$, and current scaling ratio the $I_{data}/I_{oled}$ is the same as that in formulas (1)-(10) in the pixel unit driving circuit according to the first embodiment, and details omitted.

In the above-mentioned embodiments of the pixel unit driving circuit, amount and on-off of the driving current $I_{oled}$ and data current $I_{data}$ can be controlled via the switching unit to make the current scaling ratio $I_{data}/I_{oled}$ change inversely as $I_{oled}$ changes, thus guaranteeing the data current $I_{data}$ can quickly charge the first capacitor regardless of amount of the driving current $I_{oled}$ so as to improve the refresh rate of the pixel unit driving circuit, which is helpful for achieving a high-resolution display of an image and meanwhile reducing the power consumption of the power supply when a high-brightness image is displayed. Also, the driving current $I_{oled}$ can be controlled by controlling numeric value of the external input data current $I_{data}$, thus controlling the display luminance of the light-emitting device.

The present disclosure also provides a pixel unit, including an OLED, and any one of the aforementioned pixel unit driving circuit, wherein said pixel unit driving circuit being connected to the cathode of said OLED, the anode of said OLED being connected to the high-voltage signal terminal Vdd.

The present disclosure also provides a display device, comprising the pixel unit in the aforementioned embodiments.

It can be understood that the above embodiments are only exemplary embodiments which are used for illustrating the principle of the present disclosure. However, the present disclosure is not limited thereto. Various modifications or improvements can be made by an ordinary skill in the art without departing from the spirit and substance of the present disclosure, and these modifications or improvements are also considered as the protection scope of the present disclosure.

What is claimed is:

1. A pixel unit includes an OLED, and a pixel unit driving circuit, said pixel unit driving circuit being connected to the cathode of said OLED, the anode of said OLED being connected to the high-voltage signal terminal, wherein said pixel unit driving circuit comprises:

a switching unit having a first terminal connected to a high-voltage signal terminal, a second terminal connected to a light-emitting device, a third terminal connected to a first control line, and a fourth terminal connected to a second control line;

a driving transistor having a drain connected to the switching unit, and a source connected to a low-voltage signal terminal;

a capacitance storage unit having a first terminal connected to the gate of the driving transistor, a second terminal connected to the source of the driving transistor, and a third terminal connected to the second control line, said capacitance storage unit includes: a first capacitor, a second capacitor, and a fifth transistor; wherein said first capacitor having one terminal connected to the gate of said driving transistor, and another terminal connected to the source of the driving transistor;

said second capacitor having one terminal connected to the gate of said driving transistor, and another terminal connected to the drain of said fifth transistor;

said fifth transistor having a gate connected to said second control line, and a source connected to the source of said driving transistor.

2. A pixel unit includes an OLED, and a pixel unit driving circuit, said pixel unit driving circuit being connected to the cathode of said OLED, the anode of said OLED being connected to the high-voltage signal terminal, wherein said pixel unit driving circuit comprises:

a switching unit having a first terminal connected to a high-voltage signal terminal, a second terminal connected to a light-emitting device, a third terminal connected to a first control line, and a fourth terminal connected to a second control line;

a driving transistor having a drain connected to the switching unit, and a source connected to a low-voltage signal terminal;

a capacitance storage unit having a first terminal connected to the gate of the driving transistor, a second terminal connected to the source of the driving transistor, and a third terminal connected to the second control line, said capacitance storage unit includes: a first capacitor, a second capacitor, and a fifth transistor; wherein said first capacitor having one terminal connected to the gate of the driving transistor, and another terminal connected to one terminal of said second capacitor;

said second capacitor having another terminal connected to the source of the driving transistor;

said fifth transistor having a drain connected between said first capacitor and the second capacitor, a gate connected to the second control line, and a source connected to the source of said driving transistor.

3. The pixel unit according to claim 1, wherein said switching unit comprises: a second transistor, and a fourth transistor;

said second transistor having a drain connected to the high-voltage signal terminal, a gate connected to the second control line, and a source connected to the drain of said driving transistor;

said fourth transistor having a source connected to the gate of said driving transistor, a gate connected to the first control line, and a drain connected to the high-voltage signal terminal.

4. The pixel unit according to claim 3, said switching unit further comprises:

a third transistor having a source connected to the drain of said driving transistor, a drain connected to the high-voltage signal terminal, and a gate connected to the first control line.

5. The pixel unit driving circuit according to claim 4, the driving transistor, the second transistor, the third transistor, the fourth transistor, and the fifth transistor are n-type thin film transistors.

6. A display device comprises plurality of pixel units, the pixel unit includes an OLED, and a pixel unit driving circuit, said pixel unit driving circuit being connected to the cathode of said OLED, the anode of said OLED being connected to the high-voltage signal terminal, wherein said pixel unit driving circuit comprises:

a switching unit having a first terminal connected to a high-voltage signal terminal, a second terminal connected to a light-emitting device, a third terminal connected to a first control line, and a fourth terminal connected to a second control line;

a driving transistor having a drain connected to the switching unit, and a source connected to a low-voltage signal terminal;

a capacitance storage unit having a first terminal connected to the gate of the driving transistor, a second terminal connected to the source of the driving transistor, and a third terminal connected to the second control line, said capacitance storage unit includes: a first capacitor, a second capacitor, and a fifth transistor; wherein said first capacitor has one terminal connected to the gate of said driving transistor, and another terminal connected to the source of the driving transistor, said second capacitor has one terminal connected to the gate of said driving transistor, and another terminal connected to the drain of said fifth transistor, said fifth transistor has a gate connected to said second control line, and a source connected to the source of said driving transistor, or said first capacitor has one terminal connected to the gate of the driving transistor, and another terminal connected to one terminal of said second capacitor, said second capacitor has another terminal connected to the source of the driving transistor, said fifth transistor has a drain connected between said first capacitor and the second capacitor, a gate connected to the second control line, and a source connected to the source of said driving transistor.

7. The pixel unit according to claim 2, wherein said switching unit comprises: a second transistor, and a fourth transistor;

said second transistor having a drain connected to the high-voltage signal terminal, a gate connected to the second control line, and a source connected to the drain of said driving transistor;

said fourth transistor having a source connected to the gate of said driving transistor, a gate connected to the first control line, and a drain connected to the high-voltage signal terminal.

8. The pixel unit according to claim 7, said switching unit further comprises:

a third transistor having a source connected to the drain of said driving transistor, a drain connected to the high-voltage signal terminal, and a gate connected to the first control line.

9. The pixel unit driving circuit according to claim 8, the driving transistor, the second transistor, the third transistor, the fourth transistor, and the fifth transistor are n-type thin film transistors.

* * * * *